US005080017A

United States Patent [19]

Asikainen

[11] Patent Number: 5,080,017

[45] Date of Patent: Jan. 14, 1992

[54] IGNITION CARTRIDGE SYSTEM

[75] Inventor: Niilo Asikainen, Tampere, Finland

[73] Assignee: Pocal Industries, Inc., Scranton, Pa.

[21] Appl. No.: 643,918

[22] Filed: Jan. 18, 1991

[51] Int. Cl.[5] ..... F42B 30/10

[52] U.S. Cl. ..... 102/372; 102/285

[58] Field of Search ..... 102/372, 373, 430, 432, 102/283, 284, 285, 287, 291, 292

[56] References Cited

U.S. PATENT DOCUMENTS

| | | | |
|---|---|---|---|
| 399,883 | 3/1889 | Graydon | 102/284 |
| 838,748 | 12/1906 | Du Pont | 102/430 |
| 1,633,710 | 6/1927 | Newton | 102/372 |
| 2,043,256 | 6/1936 | McLeod | 102/373 |
| 3,182,595 | 5/1965 | Hassmann | 102/202 |
| 3,204,560 | 9/1965 | Gustavson | 102/285 |
| 3,429,264 | 2/1969 | Oversohl et al. | 102/288 |
| 3,898,934 | 8/1975 | Mercier et al. | 102/285 |
| 4,413,567 | 11/1983 | Frostig | 102/372 |
| 4,876,962 | 10/1989 | Olsson | 102/292 |

*Primary Examiner*—David H. Brown
*Attorney, Agent, or Firm*—Neil F. Markva

[57] ABSTRACT

A fin-stabilized projectile comprises a body section and a tail section disposed along a longitudinal axis. The tail section includes an outer end portion, a fin-carrying portion, and a boom portion having a tubular wall defining an ignition propellant gas chamber with a plurality of propellant gas ejection holes therein. An ignition cartridge load package includes a main propellant charge and an end cap firing section. The main propellant charge is disposed within the tubular boom portion and includes compacted particulate propellant material. The particulate propellant material forms a rigid, elongated wall structure defining open passageways for directing propellant igniting gases from the end cap firing section through the boom portion toward the body section. The open passageways direct propellant igniting gases from the end cap firing section along surfaces along the wall structure to ignite the propellant material forming the wall structure. The end cap firing section includes a propellant igniting load for producing propellant igniting gases adjacent the open passageways of the main propellant charge.

12 Claims, 3 Drawing Sheets

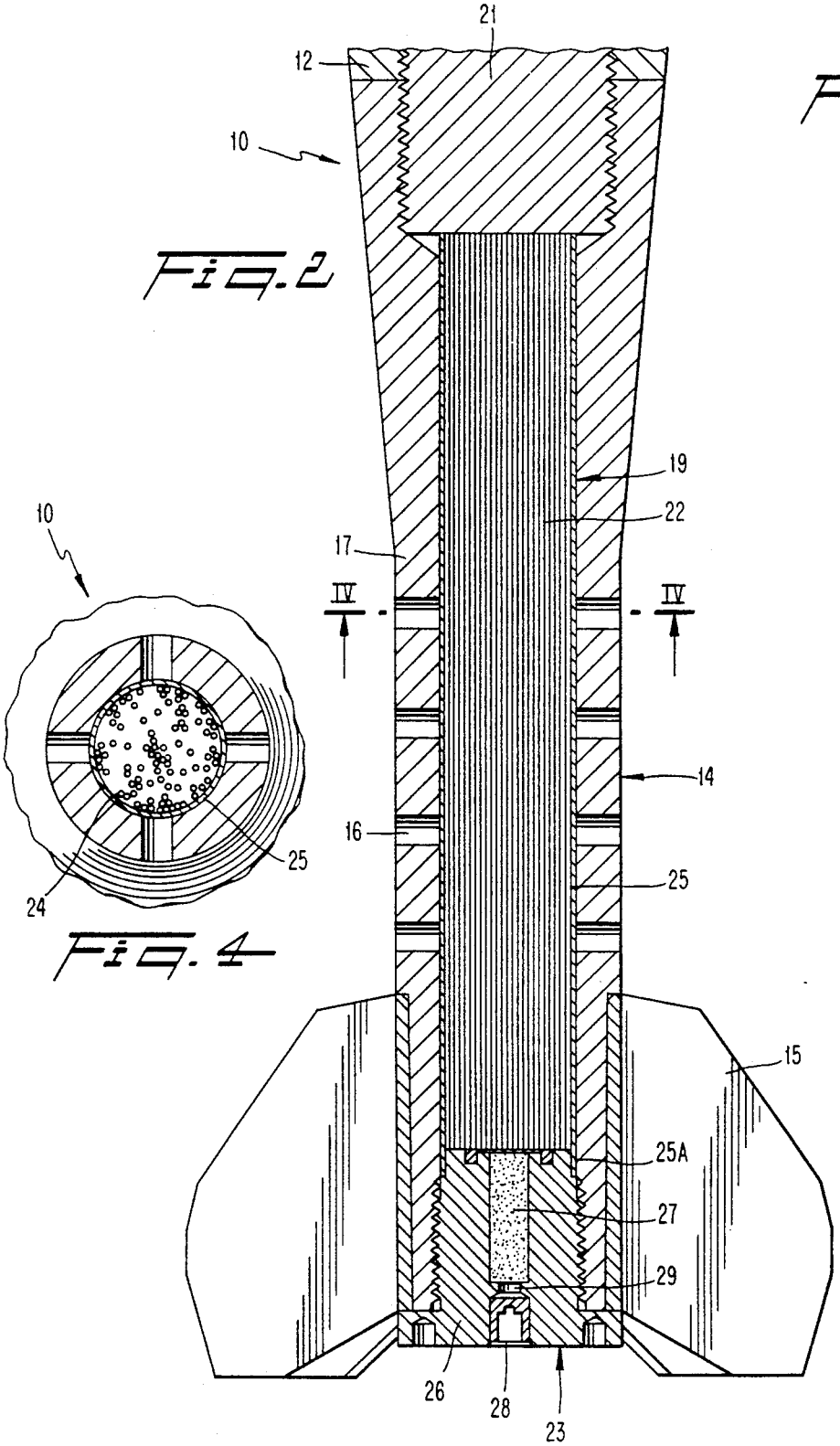
Fig. 2
Fig. 4
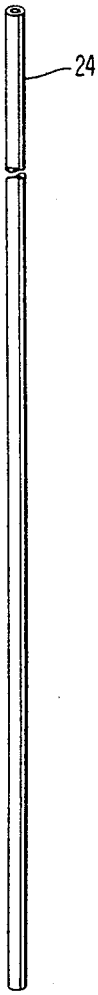
Fig. 3

IGNITION CARTRIDGE SYSTEM

FIELD OF INVENTION

This invention relates to an ignition system for a fin-stabilized projectile such as a mortar shell. More particularly, the invention relates to a ignition propellant system useful for firing a fin-stabilized projectile.

BACKGROUND OF THE INVENTION

Fin-stabilized projectiles such as mortar shells are generally fired by inserting them from above into the barrel of the weapon. The projectile has an ogival body having a tail section and slips through the barrel to its lower end. Upon reaching the lower end of the barrel, the projectile firing pin strikes the firing pin of the weapon thereby igniting an ignition cartridge disposed in the projectile tail section.

Known ignition cartridges include a particulate propellant charge disposed around a flash tube. The ignition cartridge with its flash tube fits into the boom portion of the tail section which also carries stabilizing fins. The flash tube has a plurality of holes through which the igniting gases pass to ignite the particulate propellant charge. The energetic propellant charge material begins to combust as gaseous flames move through the flash tube along the length of the ignition cartridge. Throughout the combustion process, flames escape through the plurality of holes and ignite the particulate propellant material surrounding the flash tube.

The boom portion contains the ignition charge and includes propellant gas ejection holes through which propellant gases pass into the barrel of the weapon to propel the projectile out of the barrel. Further charge increments may surround the boom portion and be ignited by the propellant gases being ejected out of the boom holes. The pressure created in the barrel by the propellant gases propel the projectile out the barrel of the weapon.

The gaseous flames emerging from the holes in the boom portion should be uniform to equally distribute propellant gases into the barrel behind the projectile. Furthermore, the gas ejection holes are of a size sufficient to burn through and penetrate other materials, such as the covering material of increment charges externally disposed on the tail boom portion. To make such needle-like flame shapes, a small hole for the flame is required, thereby increasing the pressure created upon ignition causing a corresponding increase in the possibility of an explosion that may rupture the boom portion of the tail section.

Flake powder propellant is generally universally used in combination with the flash tube configuration in known ignition cartridges for fin-stabilized projectiles. There are dangers attendant the possibility of the boom portion to fracture causing the projectile to fall short and/or fly erratically. Presently, the hydrostatic pressure testing of one hundred percent (100%) of all tail section boom portions makes sure that they are strong enough to withstand the explosion pressures developed within them upon setting off the prior art ignition cartridge.

The following U.S. Pat. No. 2,434,652; 3,182,595; 3,429,264; 4,094,248; 4,876,962; and 4,922,823 disclose various types of solid shapes used in various other types of shells.

U.S. Pat. No. 3,182,595 discloses the use of benite strands in igniter assembly used for high velocity antitank projectiles. This patentee makes an improvement in the extruded form of black powder by substituting a material referred to as benite. Nothing in this patent relates to the use of solid propellant strands for propellant load package in a fin-stabilized projectile fired by dropping the projectile into the open barrel of the weapon.

U.S. Pat. No. 4,876,962 discloses the use of a propellant charge for cannons for the purpose of providing an extremely high charged density and high progressivity with respect to such cannon ammunition. The patentee in this case does not address the igniting of an external solid increment propellant charge using an igniting load package in a fin-stabilized projectile.

U.S. Pat. Nos. 2,434,652; 2,697,325; 3,677,010 each show solid propellant materials used in firing rockets. Here, the progressive burning of the solid propellant from one end to the other is important in producing rocket movement. Nothing in these disclosures teach how to overcome the inherent problems existing with igniting particulate ignition cartridges having a flash tube.

U.S. Pat. Nos. 660,567; 660,568; 3,429,264 and 4,094,248 disclose various methods of forming solid propellant materials. However, none of these patents address the question of improving the firing of fin-stabilized projectiles from muzzle-loaded weapons.

SUMMARY OF THE INVENTION

The primary object of the invention is to provide an ignition system that enhances the effectiveness of propelling a fin-stabilized projectile out of a smooth bore barrel by the elimination of a flash tube. The propellant material is compacted particulate material having a particular shape and disposed in the tail section of the projectile to effect firing of the projectile with or without the use of externally mounted augmenting charges. The ejected propellant gases must be sufficient to both propel the projectile without any incremental charges and to penetrate the covering of incremental charges placed at any location along the projectile boom portion.

The invention is directed to an ignition cartridge load package used with a fin-stabilized projectile having a body section and a tail section disposed along a longitudinal axis. The cartridge load package comprises a main propellant section and an end cap firing section. The main propellant section includes rigid, elongated wall means composed of compacted particulate propellant material and defining open passageways for directing propellant igniting gases from the end cap firing section along surfaces of the wall means to ignite the propellant material forming the wall means. The end cap firing section includes means for producing the propellant igniting gases adjacent the open passageways of the main propellant section.

In one embodiment of the invention, the rigid, elongated wall means includes compacted propellant material shaped as a rolled sheet and having walls forming a tube of multiple sheet thickness. Here the spaces between the adjacent walls form the open passageways along the length of the elongated wall structure.

In another embodiment, the rigid, elongated wall means includes compacted propellant material shaped as a plurality of elongated propellant tubes. Here the open passageways are formed by the bores of the elongated propellant tubes within the load package.

A feature of the invention is directed to wall means disposed in container means including sheet material effective to maintain structural integrity of the main propellant section for assembly, storage and handling. The container means is adapted to slidably fit into the tail section of a fin-stabilized projectile whereby the elongated wall mean is disposed parallel to the longitudinal axis of the projectile. The sheet material is further effective to disintegrate upon the ignition of the particulate propellant material forming the wall means.

A further feature of the invention is directed to a fin-stabilized projectile comprising a body section and a tail section disposed along a longitudinal axis. The tail section includes an outer end portion, a fin-carrying portion, and a boom portion having a tubular wall defining an ignition propellant gas chamber with a plurality of propellant gas ejection holes therein. Ignition cartridge means including a main propellant charge and an end cap firing section is disposed within the tail section of the projectile. The particulate propellant material forms rigid, elongated wall means defining open passageways for directing propellant igniting gases from the end cap firing section through the boom portion toward the body section. The end cap firing section includes propellant igniting means which produces propellant igniting gases upon being set off when the projectile is dropped into the barrel of a weapon. Coupling means connect the end cap firing section to the outer end portion of the tail section.

The propellant igniting means is disposed adjacent one end of the wall means for directing propellant igniting gases into the open passage was upon firing of a projectile dropped into the barrel of a weapon. The end cap firing section includes primer means and striker means for setting off the primer means which comprise firing means for setting off the propellant igniting means. The firing means is disposed in breach plug means coupled to the outer end portion of the tail section. The propellant gas ejection holes in the boom portion of the tail section have a size effective to form a piercing flame upon ignition of the compacted particulate propellant for penetrating and setting off any propellant increment charge packages externally disposed on the tail section.

Pressure consistency is due to the uniform ignition of the disclosed rigid, elongated structural shapes along which the igniting gases are distributed upon firing of the weapon. Due to pressure consistency within the ignition cartridge, the pressure within the boom itself will be constant and generally less than internal pressure created by known ignition cartridge systems. Constant and lower pressure is desirable since it avoids pressure surges conducive to premature mortar explosion and fracture of the tail section.

Other improvements are also within reach due to the particular form and shape of propellant material in the tail section boom portion that may be made longer for providing better accuracy at zero charge and further providing for equally penetrating the covering of externally disposed propellant increment charges regardless of their position along the boom portion. With the ignition cartridge system of this invention, the boom portion of the tail section may be made longer so that a larger number of increment charges may be mounted thereon thereby improving the firing characteristics of the fin-stabilized projectile.

The ignition cartridge of the invention allows the boom to have a variety of configurations with respect to the number of propellant gas ejection holes, the diameter of these gas ejection holes, as well as the amount of propellant required within the combustion chamber. These three variables can be adjusted according to mortar projectile objectives and constraints to achieve maximum firing efficiency.

Due to the uniform distribution and consistent pressure created by the ignition cartridge tube wall structure of the invention, smaller flash holes can be employed. The smaller holes pass gaseous flames in a piercing and more needle-like shape providing reliable propelling forces in the firing barrel and being sufficient to burn through the moisture resistant covering of any externally disposed propellant charge increments. The reduction in the ejection gas hole inner diameter can be up to 50%. The needle-like flames effectively burn through moisture resistant materials that surround the rigid, elongated tube structure such as aluminum foil. The foil covering of the tube structure forms container means having a wall thickness of approximately 0.3 mm.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 2 is a fragmentary sectional view of a tail section for a projectile according to a first embodiment of the invention;

FIG. 3 is a perspective view of a rigid, elongated propellant material used in the ignition cartridge of FIG. 2;

FIG. 4 is a sectional view along line IV—IV of the tail section of FIG. 2;

DETAILED DESCRIPTION

Figure 1:
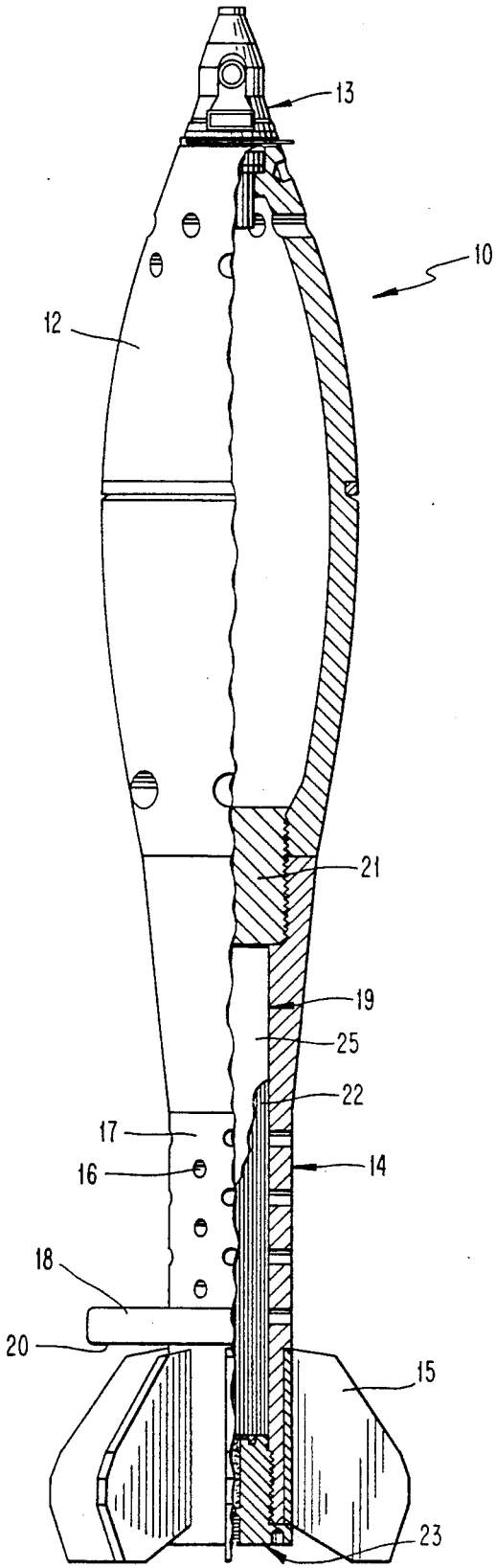
FIG. 1 is an elevational view, partially in longitudinal section, of a fin-stabilized projectile made in accordance with the invention.

The fin-stabilized projectile, generally designated 10, has an ogival shell body section 12, a detonator or fuze section 13, and a tail section 14 that carries fins 15. In this specific embodiment, the projectile is a mortar shell. Propellant gas ejection holes 16 in boom portion 17 of tail section 14 provide channels through which flames escape to fill the barrel of the weapon to propel the projectile out of the barrel. In some instances, the flames ignite externally disposed propellant charge increments as is well known. Propellant increment 18, shown in FIG. 1, exemplifies such an externally disposed charge along the length of tail section 14 and is covered with a moisture resistant covering 20.

The ignition cartridge, generally designated 19, slidably fits into tail section 14 which is threadably secured to coupling plug 21 which also threadingly engages shell body section 12. Ignition cartridge 19 includes a load package 22 and an end cap firing section 23. Load package 22 includes a plurality of rigid, elongated tubes 24 composed of compacted particulate propellant.

Propellant tubes 24 are commercially available for use in conjunction with other firearms and weapons. However, such a form of compacted, particulate propellant has never been used or suggested for use in an ignition cartridge for a fin-stabilized projectile. In this specific embodiment, nitrocellulose and nitroglycerine compose 97% of the propellant mixture with known propellant materials comprising the remaining 3% of the mixture.

New and unexpected results are achieved through use of the ignition cartridge of the invention wherein the range of the smooth bore mortar can be extended without the use of augmenting increment charges. Unexpectedly, an overall pressure reduction occurs upon setting off the main propellant charge made according to the invention. The main propellant charge is composed of rigid, elongated walls which define open passageways through which propellant igniting gases are directed from the end cap firing sections 23 and 33 to the outer end of load packages 22 and 32, respectively, toward body section 12.

In the embodiment of FIGS. 1–4, open passageways are defined by the bore of each propellant tube and the spaces formed between contiguous tubes 24 forming a bundle inside boom portion 17 of tail section 14. The rigid propellant tubes 24 are bundled and placed into aluminum foil liner 25 having a thickness of about 0.3 mm. Tubes 24 have a wall thickness of about 0.025 inch and an outer diameter of about 0.095 inch. The aluminum foil contained propellant tubes 24 form load package 22 that is slidably disposed within boom portion 17 filling up the volume of the ignition cartridge chamber of tail section 14.

Figure 5:
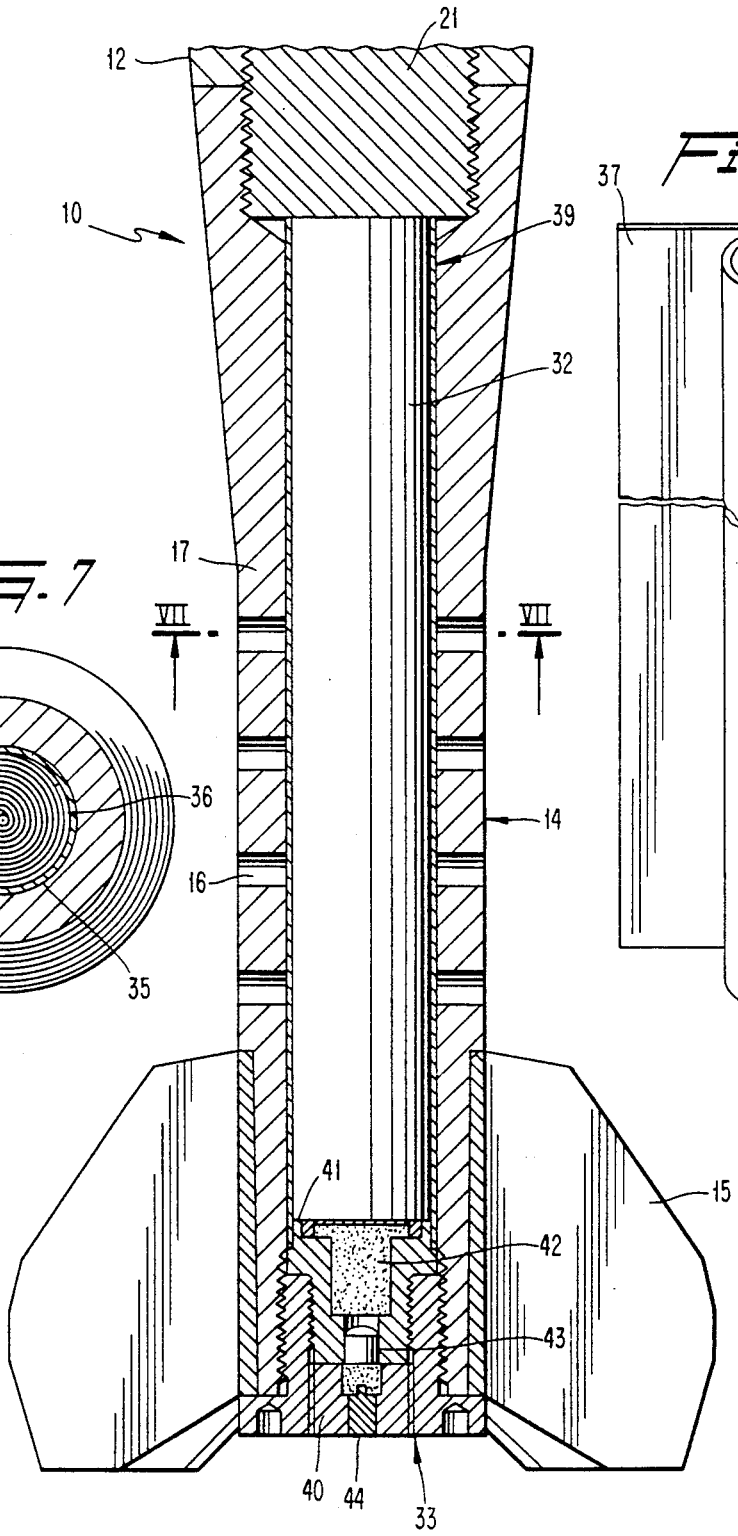
FIG. 5 is a fragmentary sectional view of a tail section for a projectile according to another embodiment of the invention.
Figure 6:
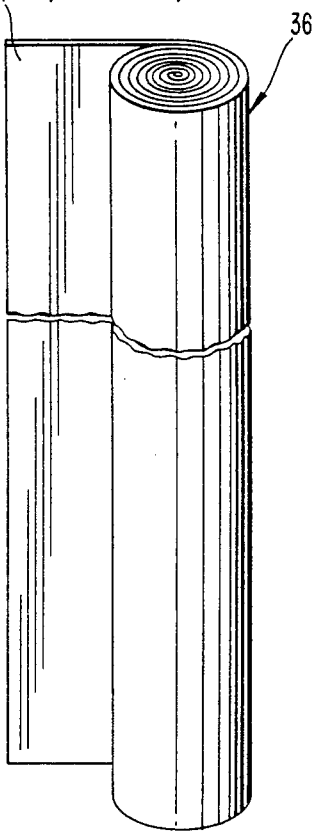
FIG. 6 is a perspective view of a propellant tube of multiple sheet wall thickness for use in the ignition cartridge of FIG. 5.
Figure 7:
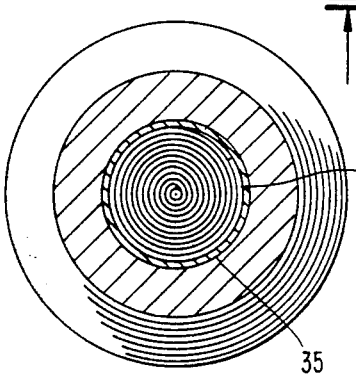
FIG. 7 is a sectional view along line VII—VII of the tail section of FIG. 5.

In the embodiment of FIGS. 5–7, open passageways are formed between the multiple layers of sheet material 37 rolled into a multiple sheet tube roll 36. The particulate propellant material is pressed into a thin sheet 37 that is rolled or coiled into a tube 36 having multiple sheet walls. This single rolled sheet forming multiple walled tube 36 is in liner container 35 within boom portion 17 of tail section 14 and constitutes the main propellant charge in ignition cartridge 39. Liner container 35 may be composed of any suitable sheet material.

The end cap firing assembly 23 in FIGS. 1–4 includes an propellant igniting load 27 composed of black powder, a primer 29, and a striker pin 28 disposed in a breech plug 26. Breech plug 26 threadingly engages the outer end portion of tail section 14. When mortar shell 10 is dropped to the bottom of a mortar launching barrel (not shown), a chain reaction begins when striker pin 28 hits the firing pin of the weapon and sets off primer 29 which, in turn sets off the black powder of propellant igniting charge 27 contiguously disposed adjacent the end of load package 22. Propellant igniting gases, produced upon combustion of the black powder, immediately enter the open passageways and are distributed along the walls of tubes 24 in load package 22 igniting the solid propellant of the main propellant charge as the gases travel therealong.

Upon combustion of load package 22, needle-like gaseous flames burn through liner 25 used to maintain the integrity of the bundle of rigid propellant tubes 24. Liner 25 may be composed of any sheet material such as aluminum foil or processed paper material. A bottom extension portion 25A of liner 25 engages breech plug 26 comprising coupling means for forming a unit.

Unexpectedly, the use of the ignition cartridge of this invention is found to produce an enhanced ejection gas flame along boom portion 17 upon explosion of the compacted propellant material. The elongated compacted propellant tube structures 24 and 36 produce an instantaneous explosion throughout the length of tail section boom portion 17 but, at the same time, substantially evenly distributes the propellant gas pressure along the length of boom portion 17 effecting the ejection of propellant gases from holes 16 for setting off the externally disposed increment charges 18.

Smaller propellant gas ejection holes 16 may now be used to enhance the force of the propelling gases to fire projectile 10 and, when used, to ignite externally disposed charge increments 18 for increasing the projectile range. Furthermore, using a standard wall thickness for boom portion 17, the size of the main propellant charge may be significantly increased by simply making the ignition charge chamber longer to contain a longer tube structure of compacted propellant material. The longer boom portion 17 accommodates a larger number of increment charges 18.

The end cap firing section or breech plug firing assembly, generally designated 33 in FIG. 5, includes the means for producing the propellant igniting gas used to set off the main propellant charge or load package 32. End cap assembly 33 includes a breech plug 40, a primer charge insert 41, propellant igniting charge 42, primer 43 and a floating firing pin 44. Here, firing pin 44 sets off primer 43 which, in turn, activates propellant igniting charge 42 producing the desired propellant igniting gases. The open spaces between the multiple walls provide the open passageways through which the propellant igniting gases are directed thereby igniting the solid propellant material costituting the rigid, elongated walls of tube 36.

The structure of the ignition cartridge of this invention produces a substantially uniform distribution of pressure upon ignition of the solid main propellant charge along the entire length thereof. Furthermore, due to the uniform distribution, the total internal pressure inside tail section 14 achieved to fire the fin-stabilized projectile is less than that obtained from known flash tube ignition cartridges.

While the ignition cartridge system has been shown and described in detail, it is obvious that this invention is not to be considered as limited to the exact form disclosed, and that changes in detail and construction may be made therein within the scope of the invention without departing from the spirit thereof.

Having set forth and disclosed the nature of this invention, what is claimed is:

1. An ignition cartridge load package for use with a fin-stabilized projectile having a body section and a tail section disposed along a longitudinal axis, said cartridge load package comprising:

a) a main propellant section and an end cap firing section, b) said main propellant section composed of a plurality of rigid, elongated propellant tubes including compacted particulate propellant material and defining open passageways through the tubes for directing propellant igniting gases from the end cap firing section along surfaces of the tubes to ignite the propellant material forming said tubes, c) said end cap firing section including means for producing propellant igniting gases adjacent the open passageways of the main propellant section.

2. A cartridge load package as defined in claim 1 wherein said main propellant section includes sheet material having a thickness of about 0.3 mm for containing the plurality of tubes.

3. A combination comprising:

a) a cartridge load package and a fin-stabilized projectile having a body section and a tail section disposed along a longitudinal axis, b) said load package including a plurality of tubes disposed in container means including sheet material effective to maintain structural integrity of the load package for assembly, storage and handling, c) said container means slidably disposed in said tail section of said fin-stabilized projectile whereby the elongated tubes are disposed parallel to the longitudinal axis of the projectile, and d) said sheet material is further effective to disintegrate upon the ignition of the particulate propellant material forming said tubes.

4. An ignition cartridge load package for use with a fin-stabilized projectile having a body section and a tail section disposed along a longitudinal axis, said cartridge load package comprising:

a) a main propellant section and an end cap firing section, b) said main propellant section composed of rigid, elongated wall means including compacted particulate propellant material and defining open passageways for directing propellant igniting gases from the end cap firing section along surfaces of the wall means to ignite the propellant material forming said wall means, c) said end cap firing section including means for producing propellant igniting gases adjacent the open passageways of the main propellant section, d) said rigid, elongated wall means including compacted propellant material shaped as a rolled sheet having walls forming a tube of multiple sheet thickness.

5. A fin-stabilized projectile comprising:

a) a body section and a tail section disposed along a longitudinal axis, b) said tail section including an outer end portion, a fin-carrying portion, and a boom portion having a tubular wall defining an ignition propellant gas chamber with a plurality of propellant gas ejection holes therein, and c) ignition cartridge means including a main propellant charge and an end cap firing section, d) said main propellant charge being disposed within said tubular boom portion and including compacted particulate propellant material, e) said particulate propellant material forming rigid, elongated wall means defining open passageways for directing propellant igniting gases from the end cap firing section through the boom portion toward the body section, f) said end cap firing section including propellant igniting means which produces propellant igniting gases upon being set off when the projectile is dropped into the barrel of a weapon, and g) coupling means for connecting the end cap firing section to the outer end portion of the tail section, h) said main propellant charge including a plurality of rigid, elongated propellant tubes disposed parallel to the longitudinal axis of the body section to define said open passageways.

6. A projectile as defined in claim 5 wherein said plurality of rigid, elongated tubes are bundled together in containing means effective to slidably contiguously fit into the tail section the a fin-stabilized projectile.

7. A projectile as defined in claim 5 wherein propellant increment charge packages are externally disposed along the boom portion of said tail section, the propellant gas ejection holes have a size effective to form a piercing flame upon ignition of the compacted particulate propellant for penetrating and setting off said propellant increment charge packages.

8. A projectile as defined in claim 5 wherein said propellant igniting means is disposed adjacent one end of the plurality of tubes for directing propellant igniting gases into the open passageways upon firing of a projectile dropped into the barrel of a weapon.

9. A projectile as defined in claim 8 wherein said end cap firing section includes primer means and striker means for setting off the primer means and igniting the main propellant charge when the projectile is dropped into the barrel of a weapon.

10. A projectile as defined in claim 5 wherein said coupling means includes breech plug means coupled to the outer end portion of the tail section, said end cap firing section includes firing means for setting off the propellant igniting means, said firing means being disposed in said breech plug means.

11. A projectile as defined in claim 10 wherein said elongated tubes are disposed in a containing sheet material connected to the end cap firing section.

12. A fin-stabilized projectile comprising:

a) a body section and a tail section disposed along a longitudinal axis, b) said tail section including an outer end portion, a fin-carrying portion, and a boom portion having a tubular wall defining an ignition propellant gas chamber with a plurality of propellant gas ejection holes therein, c) ignition cartridge means including a main propellant charge and an end cap firing section, d) said main propellant charge being disposed within said tubular boom portion and including compacted particulate propellant material, e) said particulate propellant material forming rigid, elongated wall means defining open passageways for directing propellant igniting gases from the end cap firing section through the boom portion toward the body section, f) said end cap firing section including propellant igniting means which produces propellant igniting gases upon being set off when the projectile is dropped into the barrel f a weapon, and g) coupling means for connecting the end cap firing section to the outer end portion of the tail section, h) said main propellant charge including a rolled sheet of compacted particulate propellant material having spaced walls to form a tube of multiple sheet thickness extending in a direction parallel to the longitudinal axis of the body section.

* * * * *